US005913640A

United States Patent [19]

Bortner

[11] Patent Number: 5,913,640

[45] Date of Patent: Jun. 22, 1999

[54] WEIGHT DROP POCKET FOR SCUBA DIVERS

[76] Inventor: R. Blake Bortner, 16720 Selby Dr., San Leandro, Calif. 94578

[21] Appl. No.: 08/955,772

[22] Filed: Oct. 22, 1997

[51] Int. Cl.[6] ..... B63C 11/02

[52] U.S. Cl. ..... 405/186; 2/102; 224/229; 441/88; 405/185

[58] Field of Search ..... 405/186, 185; 114/315; 224/191, 211; 441/106, 88

[56] References Cited

U.S. PATENT DOCUMENTS

| | | | |
|---|---|---|---|
| 3,039,273 | 6/1962 | Swindell | 405/186 |
| 3,263,432 | 8/1966 | Maskell | 405/186 |
| 4,440,525 | 4/1984 | Perla | 405/186 |
| 4,887,932 | 12/1989 | Toth | 405/186 |
| 5,076,575 | 12/1991 | Eylander | 405/186 X |
| 5,085,163 | 2/1992 | Van Tassel et al. | 405/186 |
| 5,641,247 | 6/1997 | Seligman | 405/186 |

*Primary Examiner*—Dennis L. Taylor

[57] ABSTRACT

A weight drop pocket for a SCUBA diver comprising a flap closed pocket for containing a weight with a stiffener secured to the pocket and having an opening through which a projection from a mating element secured to a skin diver apparatus may be inserted with the pocket and mating element retained in a preselected orientation and held in place by a spring biased rod inserted through the projection thereby locking it to the mating element until the rod is withdrawn by a force which overcomes the spring bias.

7 Claims, 3 Drawing Sheets

WEIGHT DROP POCKET FOR SCUBA DIVERS

BACKGROUND OF THE INVENTION

1. Field of the Invention

The present invention relates to weight drop pockets for SCUBA divers and, more particularly, to a means for mating a weight drop pocket to a buoyancy compensator worn by the diver with a quick release spring-loaded pull-pin release cord which when activated pulls the weight drop pocket away from the diver.

2. Description of the Prior Art

A buoyancy compensator, called a BC, and weight pockets securable or integral thereto, have been long utilized in the sport of SCUBA diving for adjusting the buoyancy of the diver. The weight systems are also usually provided with release mechanisms so that the weights can be dropped by the diver in the event of an emergency so that he can quickly increase his buoyancy to assist his rise to the surface without the impediment and drag of the weights.

SUMMARY OF THE INVENTION

The present invention is a weight drop pocket for a SCUBA diver which is comprised of a pocket having a closure means which contains a weight inserted into the pocket. The pocket contains an opening through which a projection from a mating element may be inserted. The mating element is formed for securement to an apparatus worn by the diver such as a buoyancy compensator. A projection is formed on the mating element to project through the opening in the pocket when it is disposed in mating relation therewith. The projection includes an opening formed therein whereby a rod projecting therethrough prevents the withdrawal of the stiffener from mating engagement with the mating element. A spring-loaded rod having a handle secured to one end thereof is formed for insertion through the opening in the projection when the mating element and the pocket are engaged. As a result, the rod is maintained in the opening by spring bias to lock the pocket and the mating element into engagement thereby attaching the pocket to the apparatus which is worn by the diver. When the rod is withdrawn from the opening by pulling the handle and overcoming the bias of the spring to release the pocket from the apparatus, the spring bias then pulls the weight pocket away from the diver until the handle is released whereby the pocket is thereby permitted to free fall away from the diver reducing his buoyancy and permitting an unhindered or increased buoyancy emergency rise to the surface.

OBJECTS OF THE INVENTION

It is therefore an important object of the present invention to provide a self-contained quick release weight drop system for SCUBA divers.

It is another object of the present invention to provide a spring-biased rip-cord weight drop system for SCUBA divers which, when activated, pulls the weight away from the diver.

It is a further object of the present invention to provide a weight drop pocket for SCUBA divers which is attached to a buoyancy compensator worn by the diver and which can be released by pulling on a handle to thereby disengage the weight from the buoyancy compensator and pull the weight from the diver for free fall of the weight away from the diver for an emergency ascent.

It is still another objection of the present invention to provide a weight drop pocket for SCUBA divers which has a spring biased rip-cord release system that is self-contained in and integral to said pocket.

And it is yet a further object of the present invention to provide a weight drop pocket which has a single point attachment to a SCUBA diver's buoyancy compensator and is form fitting and effects free fall away from the diver when it is released by a short pull on a rip cord handle which, in turn, pulls the weight away from the diver.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
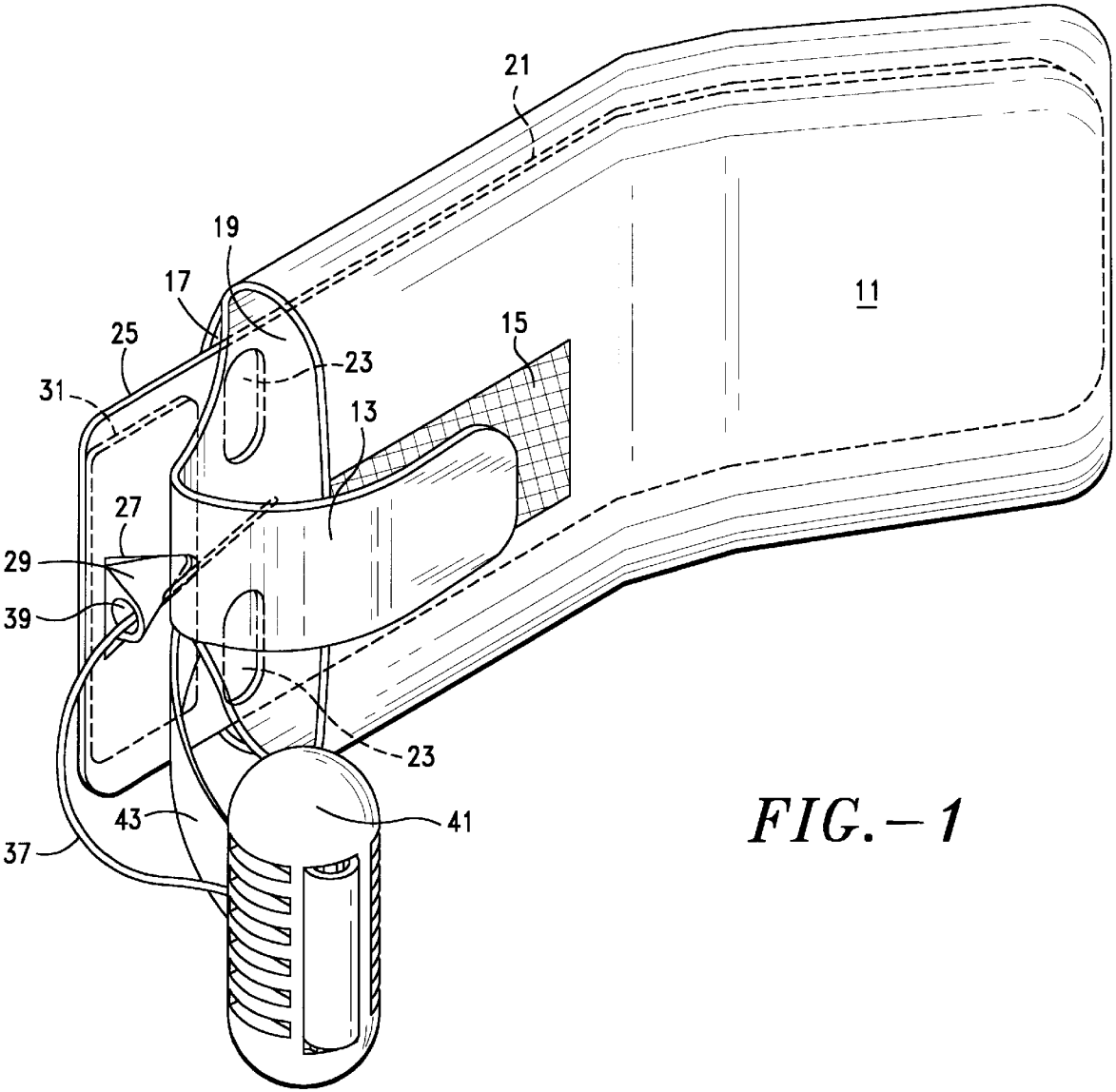
FIG. 1 is a perspective view of the SCUBA diver weight drop pocket of the present invention.

FIG. 1 illustrates a weight drop pocket 11 for SCUBA divers wherein a pocket having a closure means is formed to contain a weight which is inserted into the pocket. In some cases the inserted weights are unitary, but usually the weights are comprised of lead or steel shot enclosed in envelopes or bags whereby the loose weight in the container can be finely adjusted to the exact weight required for the desired buoyancy of the particular diver. The closure means is typically a latch flap 13 which can be secured closed by hook and loop fabric fasteners 15 or engagement closures sewn to the pocket and flap. However, the two sides of the end of the pocket could be secured together and held closed by buttons, snaps, zippers, or other closures or fasteners.

In a preferred embodiment of the invention, the weight pocket 11 is supplied with a second separate parallel compartment or pocket 17 formed on the backside of the first or weight-containing compartment or pocket 19. It is formed integral to the weight containing pocket whereby a stiffener 21 can be inserted into the second pocket and thereby be formed integral into the weight-containing pocket.

Figure 2:
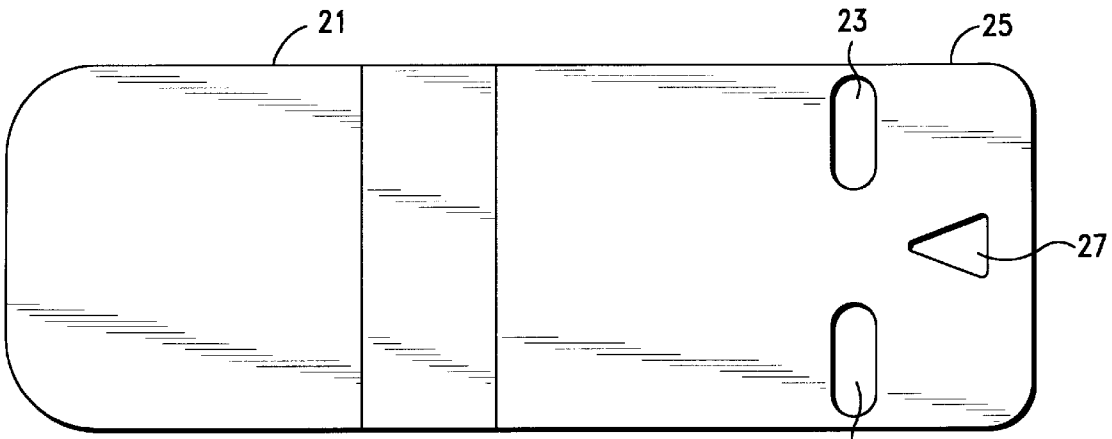
FIG. 2 is a top plan view of the stiffener as used with the present invention.
Figure 3:
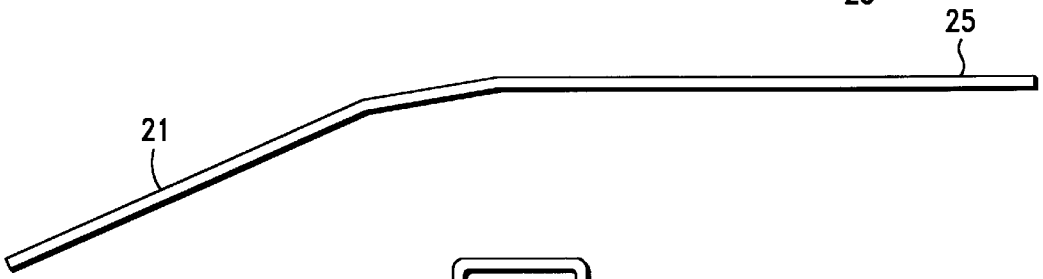
FIG. 3 is a side elevation thereof.

The stiffener 21 of the preferred embodiment is shown in FIGS. 2 and 3. It is formed with a curved or bent configuration which, when inserted into the second pocket 17, and when the apparatus is secured to the diver, holds the weights in conformity close around the body of the diver in the region of his waist. Generally, a pair or pairs of pockets are positioned on the diver for balance and to divide up the weight and reduce the bulk of the pocket size for streamlining.

In the preferred embodiment of the invention, the weight drop pocket 11 is itself inserted into a horizontal pocket formed in the diver's buoyancy compensator or BC. The horizontal BC pocket has a vertical slit facing the front of the BC which is the opening for the insertion of the weight drop pocket. When the diver is swimming horizontally, the slit or opening of the BC pocket is reoriented 90 degrees from his vertical orientation so that the BC pocket opening faces downward and the weight drop pocket would fall out of the BC if it were not restrained therein. The curve in the stiffener 21, and the positioning of the horizontal pockets in the BC, at the lower side edges thereof, locate and saddle the weight drop pockets above and around the diver's hips. In the event a pocket is released in an emergency when the diver is swimming normally, the weight free-falls forward with respect to his body and downward, out of the BC pocket and away from the diver, and does not tangle or interfere with any other portion of the diver's apparatus.

The stiffener 21 in a preferred form is provided with several openings. A pair of the openings 23 near one end of a preferred embodiment are used to permit sewing of the top ends of the second compartment 17 of the weight drop pocket 11 together, through the stiffener, to hold the stiffener in the second pocket. The upper portion 25 of the stiffener projecting externally of the pocket contains a first opening 27 which is irregular and through which a projection 29 from a mating element 31 may be inserted. In a preferred embodiment of the design, this opening has a triangular configuration which permits a triangular pyramid projection formed on or secured to the mating element to easily locate and penetrate and project therethrough for quick alignment and orientation of the pocket to the apparatus worn by the diver to engage the weight pocket to him.

Figure 4:
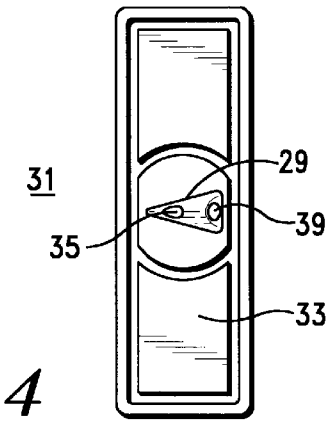
FIG. 4 is a top plan view of the mating element as used with the present invention.
Figure 5:
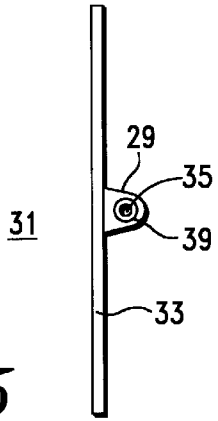
FIG. 5 is an end elevation thereof.

The mating element 31 is shown in FIGS. 4 and 5. It is formed for securement to the apparatus which is engaged to or worn by a diver such as a BC, a weight belt, or a special harness adapted for attachment of the mating element. In the preferred embodiment of the invention, the mating element is secured internally at the front edge of the horizontal pocket formed in the BC. The element preferably has a flat base 33 to permit it to be secured to the apparatus worn by the SCUBA diver by alternative means such as gluing with adhesives, securement by sewing or rivets, or any other of the various means of suitable attachment. The projection 29 formed on or secured to the mating element is formed to project through the stiffener 21 of the pocket 11 when the mating element is disposed in mating relation therewith, or in the preferred embodiment, when the weight pocket is inserted in the horizontal pocket of the BC and aligned with the mating element disposed therein. The projection can be a separate element which is secured to the mating element in such a way as to be integral thereto. In the preferred embodiment, the projection has a triangular base, to engage the triangular hole 27 in the stiffener, and a pyramid shape in the rise portion of the projection to permit easy location and quick penetration by the pointed projection through the hole in the stiffener without visual guidance. The triangular configurations of the first opening and the projection maintain the weight drop pocket in a preselected orientation with respect to the mating element and thereby to the apparatus to which the element is attached such as a BC worn by the diver.

The projection 29 includes an opening or passageway formed therein whereby a locking element in the form of a rod 37 projecting therethrough prevents the withdrawal of the stiffener 21 from its mating engagement with the mating element 31. The passageway is spaced from the base of the pyramid generally mid-height on the rise portion of the projection whereby the engagement connection is a loose engagement permitting easy disengagement. The passageway in the projection in the preferred embodiment of the invention has a beveled recess at the entrance 39 to assist the insertion of the rod into the passageway when the rod is placed therein to lock the weight drop pocket into engagement with the mating element in the BC or any other apparatus worn by the diver as a result of which it may be secured to the diver.

In the present invention, the rod or pull-cord 37 is spring-loaded with a handle 41 secured to one end thereof whereby when the rod is inserted through the passageway 35 in the projection 29 of the mating element 31, it is maintained in the passageway by spring bias to retain the stiffener 21 and mating element in engagement. The rod is a semi-flexible pull-cord, having a semi=rigidly positioned handle secured to one end thereof. The rod is rigid enough to support the weight of the handle and attached biasing member in a preferred orientation projecting from the end of the pocket for easy location and grasping by the diver without looking at the handle. This arrangement results in attaching the weight drop pocket to the apparatus, which is engaged to the diver, until the rod is withdrawn from the passageway by a pull on the handle. The action overcomes the spring bias to release the pocket from engagement with the mating element projection secured to the apparatus permitting the spring bias to in turn pull the weight pocket away from engagement with the diver until the handle is released to permit the pocket and the weight contained therein to free fall away from the diver. The rod is made of a semi-rigid plastic cord, which is somewhat flexible, whereby it essentially and functions as a pull-cord.

In the preferred embodiment of the present invention, the spring bias is provided by an elastic strap 43 which is secured internally of the second compartment 17 of the pocket holding the stiffener 21 to provide a length of elastic strap longer than the short distance from the end of the weight drop pocket to the optimum placement position for the handle 41 which is just a couple of inches displaced from the end of the pocket. By securing a first end of the elastic strap mid-length of the weight drop pocket 11, internally thereof, the handle for the rip-cord 37 is provided with a length of elastic strap which will not offer too great a bias resistance to withdrawing the pull-cord from its insertion through the projection 29 on the mating element 31, but it will also preserve the life of the elasticity of the strap by not overstretching it from multiple pull-cord stretches. The strap, by extending internally of the weight drop pocket for a portion of its length is guided thereby and continuously coordinates with the semi-rigidity of the rod to properly position or support the handle with respect to the end of the pocket for grasping by the diver because the elastic strap is restricted in its freedom of movement to so position the handle attached to its second end.

The strap 43 is looped through a slot in the handle 41 which engages one end of the pull-cord 37 and is sewn to itself next to the handle. The handle in the preferred embodiment is provided with an open cast construction for reduction of weight and is made of a luminescent plastic, such as florescent yellow, for increased visibility under water. If the weight drop pocket 11 is released in an emergency and allowed to sink to the bottom, a later effort to retrieve the weight is aided by the visibility of the luminescent handle.

The handle is large enough for grasping with a gloved hand and is flexibly positioned by the elastic strap so it can be easily grasped and pulled, and the diver's hand does not have to assume a particular orientation in order to be able to grasp the handle. Due to its flexible connection to the pocket, it can be manipulated to a wide range of variable orientations for grasping.

As a result of the irregular opening 27 in the stiffener 21, the mating projection 29 on the mating element 31 which is formed to mate with the irregular opening, the pocket is maintained in a preselected orientation with respect to the apparatus worn by the diver. That orientation is usually a single position alignment and is dependent upon the orientation of projection formed on the mating element and the orientation of the opening in the stiffener secured to the apparatus worn by the diver. Generally, however, the orientation of the pocket is primarily determined by the orientation of the pocket it is placed in which is formed in the buoyancy compensator.

Figure 6:
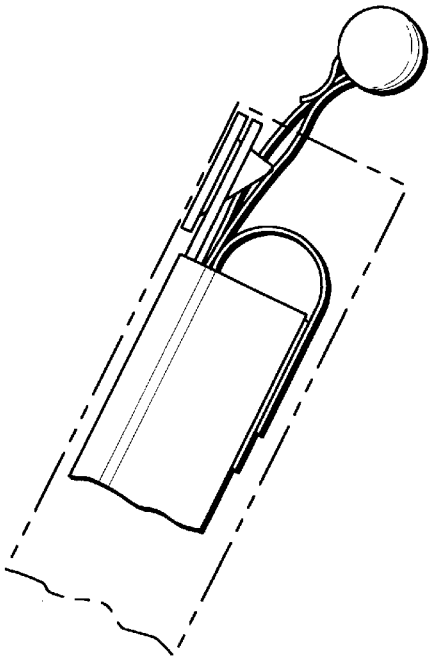
FIG. 6 is a side elevation of the present invention in repose.
Figure 7:
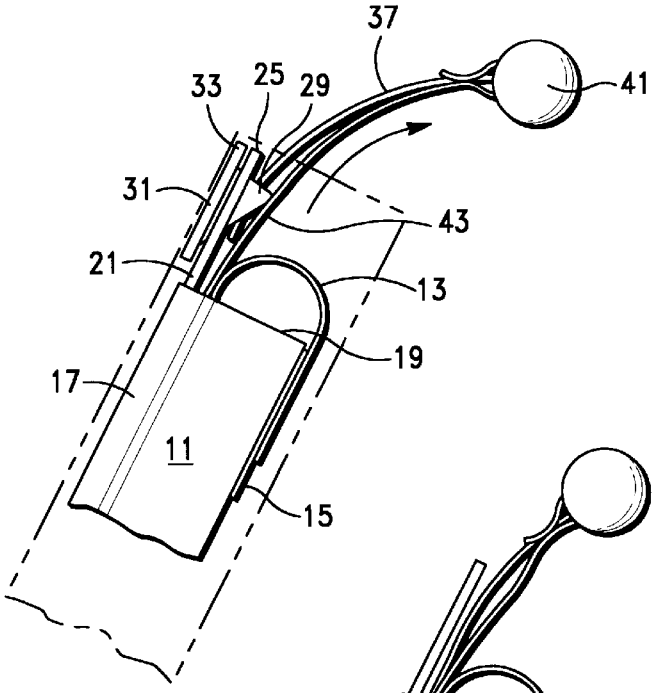
FIG. 7 is a side elevation of the present invention with the pull-cord being withdrawn from engagement against the spring bias almost to the point of disengagement.
Figure 8:
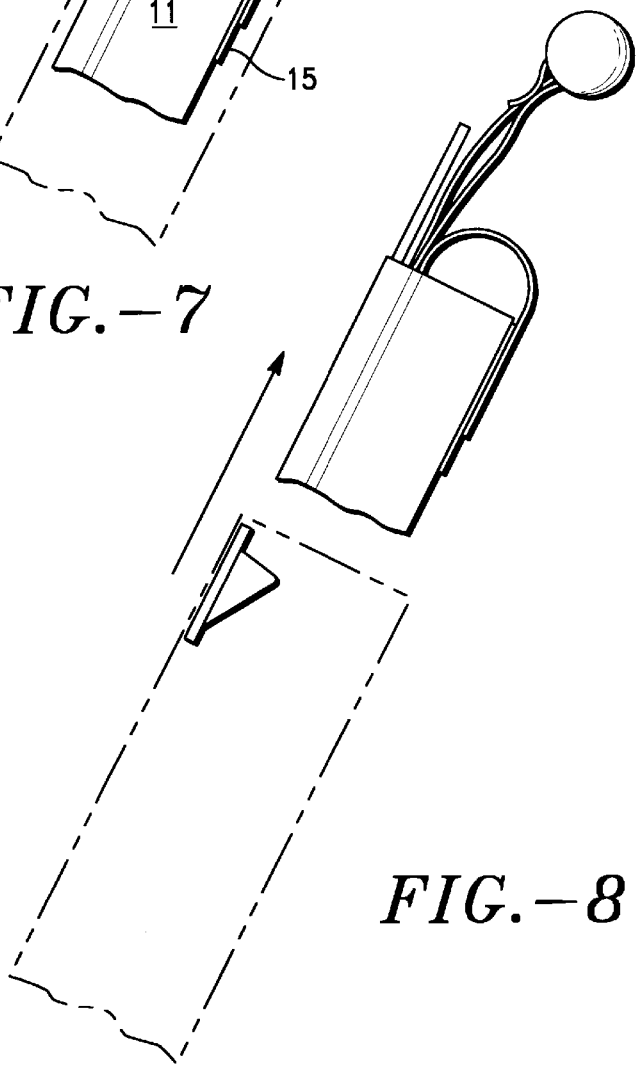
FIG. 8 shows the pull-cord extracted from locking engagement and the spring bias pulling the weight drop pocket away from engagement with the diver.

The primary purpose of the invention is achieved by providing a quick-release retainer system for securing a weight drop pocket to the BC of a SCUBA diver. This is achieved by the unique characteristics of the present invention as shown in FIGS. 6–8, the action of which is described in the DESCRIPTION OF THE DRAWINGS.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A weight drop pocket for a SCUBA diver comprising a self-contained pocket having a closure means for retaining a weight inserted into said pocket, said pocket having a first opening formed therein through which a projection secured to a diver may be inserted, a mating element formed for engaging said pocket and for securement to an apparatus engaged to said diver, said mating element having a projection formed thereon which is formed to project through said first opening in said pocket when disposed in mating relation therewith, said projection including a passageway formed therein whereby a locking element projecting therethrough prevents the withdrawal of said pocket from engagement with said mating element indirectly engaged to said diver, and a spring-biased rod forming said locking element and having a handle secured to one end thereof, said rod being formed for insertion through and positioning in said passageway formed in said projection when said mating element and said pocket are engaged in mating relation whereby said rod is maintained in said passageway by said spring bias to capture said pocket on said projection between said rod and said mating element thereby attaching said pocket to said apparatus which is engaged to said diver until said rod is withdrawn from said passageway by a pull on said handle which overcomes said spring bias to release said pocket from engagement with said projection and said mating element thereby permitting said spring bias to pull said weight pocket and weight away from said diver until said handle is released to permit said weight drop pocket to free fall away from said diver.

2. The weight drop pocket of claim 1 including a stiffener secured to said pocket and containing a perforation forming said first opening through which said projection from said mating element may be inserted.

3. The weight drop pocket of claim 2 wherein said stiffener is curved to conform to the diver's body and said first opening for receiving said projection from said mating element is irregular and said projection is formed to mate with said irregular configuration of said opening to maintain said weight drop pocket in a pre-selected orientation with respect to said mating element and said apparatus to which said element is attached when said element and said stiffener are engaged.

4. The weight drop pocket of claim 3 wherein a first end of said passageway in said projection is formed with a beveled recess to guide insertion of said rod and assist said diver in placing said rod through said passageway to engage said pocket to said diver, and said irregular first opening in said stiffener is triangular and said projection is a triangular pyramid formed for engaging said opening to orient said stiffener and thereby said pocket with respect to said mating element.

5. The weight drop pocket of claim 1 wherein said spring-bias for said rod is comprised of an elastic strap having a first end thereof secured to said pocket and a second end thereof secured to said handle to which said rod is secured.

6. The weight drop pocket of claim 5 wherein said first end of said elastic strap is secured to said weight drop pocket mid-length and internally thereof.

7. A weight drop pocket for a SCUBA diver comprising a self-contained pocket having a closure means for retaining a weight inserted into said pocket, a stiffener secured to said pocket and containing a first opening through which a projection secured to a diver may be inserted, said stiffener being curved to conform to said diver's body and said first opening formed for receiving said projection having a triangular configuration, a mating element formed for engaging said stiffener and for securement to an apparatus engaged to said diver, said mating element having a triangular pyramid projection formed thereon which is formed to project through said first opening in said stiffener when disposed in mating relation therewith and to mate with the configuration of said triangular first opening to maintain said weight drop pocket in a pre-selected orientation with respect to said mating element and the apparatus to which said element is attached, said projection including a passageway formed therethrough and having a beveled recess to guide insertion of a locking element and to assist said diver in placing of a locking element through said opening whereby said pocket is secured to said mating element and thereby to said diver and preventing the withdrawal of said stiffener and said pocket from engagement with said mating element, a rod having a handle secured to one end thereof forming a locking element, said rod formed for insertion through said passageway formed in said projection when said mating element and said stiffener are interlocked, and an elastic strap having a first end thereof secured to said pocket mid-length and internally thereof and a second end thereof secured to said handle whereby said rod is maintained in said passageway by spring bias due to said elastic strap to thereby lock said stiffener and said mating element into engagement and thereby attaching said pocket to said apparatus engaged to said diver until said rod is withdrawn from said passageway by a pull on said handle which overcomes said spring bias of said elastic strap to release said pocket from said apparatus thereby permitting said spring bias to pull said weight drop pocket away from said diver until said handle is released to permit said pocket and weight to free fall away.

* * * * *